US012808025B2

(12) United States Patent
Yanar et al.

(10) Patent No.: US 12,808,025 B2
(45) Date of Patent: Nov. 24, 2026

(54) 5XXX ALUMINUM ALLOYS

(71) Applicant: ARCONIC TECHNOLOGIES LLC, Pittsburgh, PA (US)

(72) Inventors: Cagatay Yanar, Palo Alto, CA (US); Gregory B. Venema, Le Claire, IA (US); Wei Wen, Allison Park, PA (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 264 days.

(21) Appl. No.: 18/134,969

(22) Filed: Apr. 14, 2023

(65) Prior Publication Data

US 2023/0272515 A1 Aug. 31, 2023

Related U.S. Application Data

(63) Continuation of application No. PCT/US2021/060589, filed on Nov. 23, 2021.

(60) Provisional application No. 63/117,664, filed on Nov. 24, 2020.

(51) Int. Cl.

| | |
|---|---|
| ***C22F 1/047*** | (2006.01) |
| ***C22C 21/06*** | (2006.01) |
| ***C22C 21/08*** | (2006.01) |

(52) U.S. Cl.

CPC ..... *C22F 1/047* (2013.01); *C22C 21/06* (2013.01); *C22C 21/08* (2013.01)

(58) Field of Classification Search

CPC ..... C22C 21/06; C22C 21/08; C22F 1/047

See application file for complete search history.

(56) References Cited

U.S. PATENT DOCUMENTS

| | | | |
|---|---|---|---|
| 5,624,632 | A | 4/1997 | Baumann |
| 2002/0006352 | A1 | 1/2002 | Spanjers |
| 2015/0284831 | A1 | 10/2015 | Kröpfl |

FOREIGN PATENT DOCUMENTS

| | | | | |
|---|---|---|---|---|
| CN | 101631882 | A | 1/2010 | |
| CN | 111621680 | A | 9/2020 | |
| EP | 3683327 | A1 * | 7/2020 | ..... C22F 1/047 |

OTHER PUBLICATIONS

McMahon, Matthew E. et al. Beta phase distribution in Al—Mg alloys of varying composition and temper. Corrosion Science: 169 pp. 1-12. (Year: 2020).*

Tang, Zhongqin et al. Effect of annealing temperature on microstructure, mechanical properties and corrosion behavior of Al—Mg—Mn—Sc—Zr alloy. Applied Surface Science. 514 (pp. 1-12), June. https://doi.org/10.1016/j.apsusc.2020.146081 (Year: 2020).*

International Search Report and Written Opinion of application No. PCT/US2021/060589, dated Mar. 17, 2022, 12 pp.

* cited by examiner

*Primary Examiner* — Tima M. McGuthry-Banks

(74) *Attorney, Agent, or Firm* — Greenberg Traurig, LLP

(57) ABSTRACT

New 5xxx aluminum alloys and products made therefrom are disclosed. In one approach, a new 5xxx aluminum alloy may include from 3.5 to 4.6 wt. % Mg, from 0.5 to 1.3 wt. % Mn, from 0.08 to 0.15 wt. % Sc, from 0.05 to 0.15 wt. % Zr, up to 0.8 wt. % Zn, up to 0.20 wt. % Cr, up to 0.20 wt. % V, up to 0.20 wt. % Cu, up to 0.15 wt. % Ti, up to 0.10 wt. % Fe, up to 0.10 wt. % Si, the balance being aluminum, incidental elements and impurities. The 5xxx aluminum alloy sheet product may include, for instance, at least 0.5 vol. % of beta phase particles.

19 Claims, 2 Drawing Sheets

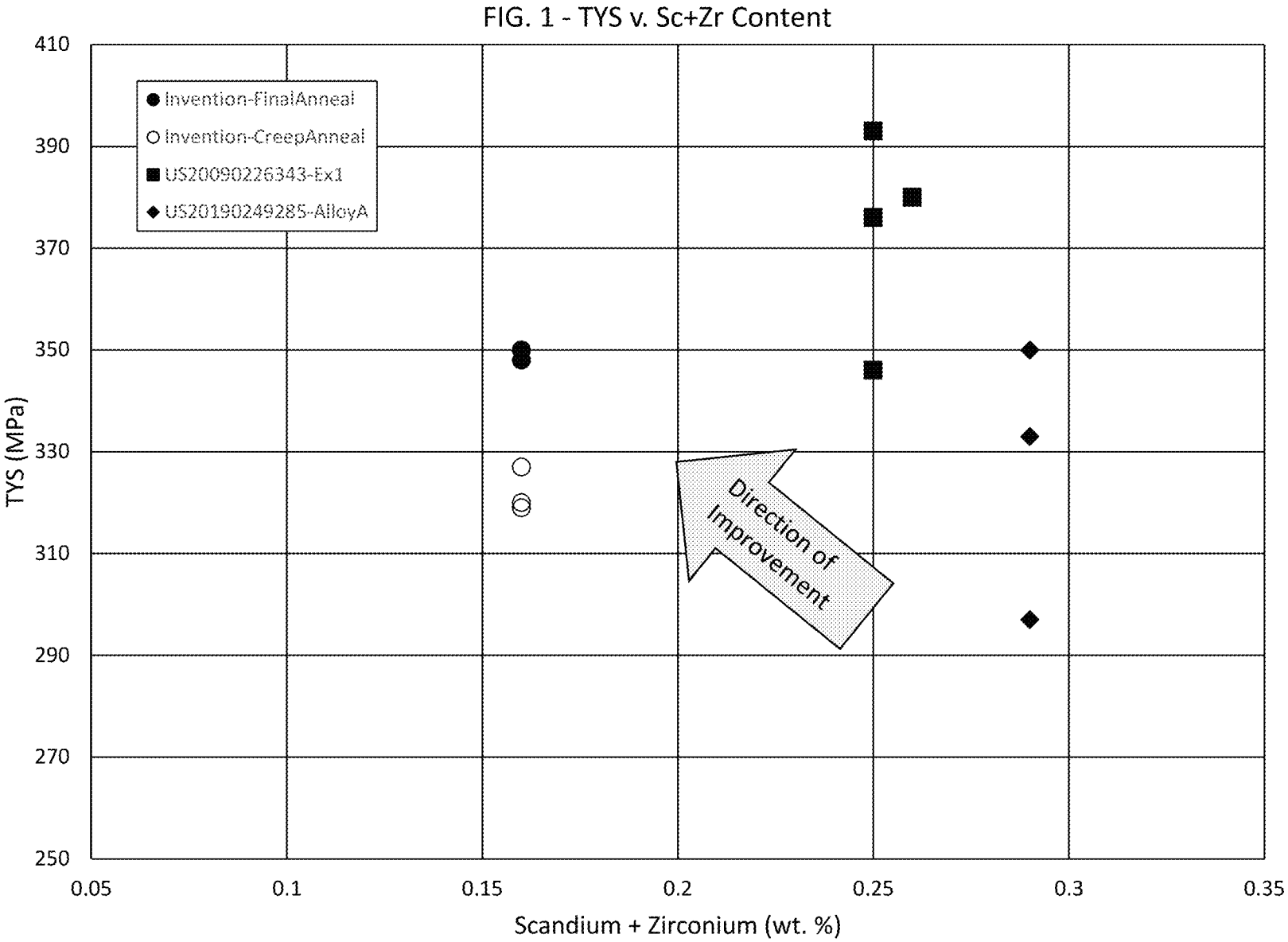
FIG. 1 - TYS v. Sc+Zr Content

5XXX ALUMINUM ALLOYS

CROSS-REFERENCE TO RELATED APPLICATIONS

This application is a continuation of international Patent Application No. PCT/US2021/060589, filed Nov. 23, 2021, which claims the benefit of U.S. Provisional Patent Application No. 63/117,664, filed Nov. 24, 2020, entitled "IMPROVED 5XXX ALUMINUM ALLOYS," each of which is incorporated herein by reference in its entirety.

BACKGROUND

Wrought aluminum alloys are generally classified by series. There are currently eight different wrought alloy series. The 1xxx series aluminum alloys contain at least about 99.00 wt. % aluminum per Aluminum Association standards. The 2xxx-5xxx and 7xxx aluminum alloys are classified according to their main alloying elements. 6xxx aluminum alloys are aluminum alloys having defined amounts of both magnesium and silicon. 8xxx aluminum alloys are aluminum alloys that do not fall within any of the 1xxx-7xxx classes.

5xxx aluminum alloys use magnesium as their main alloying ingredient. 5xxx series aluminum alloys may be employed in various industries, such as in the industrial applications. However, it is difficult to improve the performance of one property of a 5xxx aluminum alloy (e.g., strength) without decreasing the performance of a related property (e.g., corrosion resistance).

SUMMARY OF THE DISCLOSURE

Broadly, the present disclosure relates to new 5xxx aluminum alloy sheet products and methods of making the same. The new 5xxx aluminum alloy sheet products generally comprise (and in some instances consist essentially of, or consist of) from 3.5 to 4.6 wt. % Mg, from 0.5 to 1.3 wt. % Mn, from 0.08 to 0.15 wt. % Sc, from 0.05 to 0.15 wt. % Zr, up to 0.8 wt. % Zn, up to 0.20 wt. % Cr, up to 0.20 wt. % V, up to 0.20 wt. % Cu, up to 0.15 wt. % Ti, up to 0.10 wt. % Fe, and up to 0.10 wt. % Si, the balance being aluminum, incidental elements and impurities. The new 5xxx aluminum alloy sheet products generally have a thickness of from 0.5 to 8.0 mm and include at least 0.5 vol. % of beta phase particles. The beta phase particles generally define an aspect ratio distribution. In one embodiment, an AR99 of the beta phase particles is not greater than 10.0. The beta phase particles also generally define a beta phase particle size distribution. In one embodiment, a D99 of the beta phase particle size distribution is not greater than 3.0 micrometers. These and other aspects of the new 5xxx aluminum alloy sheet products are described below. Products made from the new 5xxx aluminum alloys may realize an improved combination of properties, such as an improved combination of two or more of strength, strength retention, ductility (elongation), damage tolerance and corrosion resistance.

I. COMPOSITIONS

As noted, the new 5xxx aluminum alloys generally include from 3.5 to 4.6 wt. % Mg. In one embodiment, a new 5xxx aluminum alloy includes at least 3.6 wt. % Mg. In another embodiment, a new 5xxx aluminum alloy includes at least 3.7 wt. % Mg. In yet another embodiment, a new 5xxx aluminum alloy includes at least 3.8 wt. % Mg. In another embodiment, a new 5xxx aluminum alloy includes at least 3.9 wt. % Mg. In yet another embodiment, a new 5xxx aluminum alloy includes at least 4.0 wt. % Mg. In another embodiment, a new 5xxx aluminum alloy includes at least 4.1 wt. % Mg. In one embodiment, a new 5xxx aluminum alloy includes not greater than 4.5 wt. % Mg. In another embodiment, a new 5xxx aluminum alloy includes not greater than 4.4 wt. % Mg.

As noted above, the new 5xxx aluminum alloys generally include from 0.5 to 1.3 wt. % Mn. Manganese may facilitate, for instance, proper grain structure control. The proper amount of manganese may also facilitate, for instance, realization of an appropriate amount of manganese containing particles, which may facilitate dispersion strengthening of the aluminum alloy. In one embodiment, a new 5xxx aluminum alloy includes at least 0.55 wt. % Mn. In another embodiment, a new 5xxx aluminum alloy includes at least 0.6 wt. % Mn. In yet another embodiment, a new 5xxx aluminum alloy includes at least 0.65 wt. % Mn. In another embodiment, a new 5xxx aluminum alloy includes at least 0.7 wt. % Mn. In yet another embodiment, a new 5xxx aluminum alloy includes at least 0.75 wt. % Mn. In another embodiment, a new 5xxx aluminum alloy includes at least 0.8 wt. % Mn. In yet another embodiment, anew 5xxx aluminum alloy includes at least 0.85 wt. % Mn. In one embodiment, a new 5xxx aluminum alloy includes not greater than 1.25 wt. % Mn. In another embodiment, a new 5xxx aluminum alloy includes not greater than 1.2 wt. % Mn. In yet another embodiment, a new 5xxx aluminum alloy includes not greater than 1.15 wt. % Mn. In another embodiment, a new 5xxx aluminum alloy includes not greater than 1.1 wt. % Mn. In yet another embodiment, a new 5xxx aluminum alloy includes not greater than 1.05 wt. % Mn. In another embodiment, a new 5xxx aluminum alloy includes not greater than 1.0 wt. % Mn. In yet another embodiment, anew 5xxx aluminum alloy includes not greater than 0.95 wt. % Mn.

As noted above, the new 5xxx aluminum alloys generally include from 0.08 to 0.15 wt. % Sc. The proper amount of scandium may facilitate, for instance, realization of an appropriate amount of scandium containing particles, which may facilitate an unrecrystallized grain structure, and with restricted or no recovery of the substructure during thermal treatments. An unrecrystallized grain structure may facilitate, for instance, high strength. Scandium is, however, expensive. Unexpectedly it has been found that lower levels of scandium may be used in the new 5xxx aluminum alloys disclosed herein without materially detrimentally affecting material properties. In one embodiment, a new 5xxx aluminum alloy includes not greater than 0.14 wt. % Sc. In another embodiment, a new 5xxx aluminum alloy includes not greater than 0.13 wt. % Sc. In yet another embodiment, a new 5xxx aluminum alloy includes not greater than 0.12 wt. % Sc. In another embodiment, a new 5xxx aluminum alloy includes not greater than 0.11 wt. % Sc. In yet another embodiment, a new 5xxx aluminum alloy includes not greater than 0.10 wt. % Sc.

As noted above, the new 5xxx aluminum alloys generally include from 0.05 to 0.15 wt. % Zr. Zirconium may form $Al_3Zr$ particles and/or other Zr-containing particles (including those containing scandium). The proper amount of zirconium may facilitate, for instance, realization of an appropriate amount of zirconium containing particles, which may facilitate an unrecrystallized grain structure, and with restricted or no recovery of the substructure during thermal treatments. An unrecrystallized grain structure may facilitate, for instance, high strength. Unexpectedly it has been found that lower levels of zirconium may be used in the new 5xxx aluminum alloys disclosed herein without materially detrimentally affecting material properties. In one embodiment, a new 5xxx aluminum alloy includes not greater than 0.14 wt. % Zr. In another embodiment, a new 5xxx aluminum alloy includes not greater than 0.13 wt. % Zr. In yet another embodiment, a new 5xxx aluminum alloy includes not greater than 0.12 wt. % Zr. In another embodiment, a new 5xxx aluminum alloy includes not greater than 0.11 wt. % Zr. In yet another embodiment, a new 5xxx aluminum alloy includes not greater than 0.10 wt. % Zr. In another embodiment, a new 5xxx aluminum alloy includes not greater than 0.09 wt. % Zr. In yet another embodiment, a new 5xxx aluminum alloy includes not greater than 0.08 wt. % Zr. In another embodiment, a new 5xxx aluminum alloy includes not greater than 0.07 wt. % Zr.

In one approach, the combined amount of scandium and zirconium is tailored to be low and without materially detrimentally affecting material properties. In one embodiment, the combined amount of scandium plus zirconium in a new 5xxx aluminum alloy is not greater than 0.20 wt. %, i.e., (wt. % Sc)+(wt. % Zr)≤0.20 wt. %. In another embodiment, the combined amount of scandium plus zirconium in a new 5xxx aluminum alloy is not greater than 0.19 wt. %, i.e., (wt. % Sc)+(wt. % Zr)≤0.19 wt. %. In yet another embodiment, the combined amount of scandium plus zirconium in a new 5xxx aluminum alloy is not greater than 0.18 wt. %, i.e., (wt. % Sc)+(wt. % Zr)≤0.18 wt. %. In another embodiment, the combined amount of scandium plus zirconium in a new 5xxx aluminum alloy is not greater than 0.17 wt. %, i.e., (wt. % Sc)+(wt. % Zr)≤0.17 wt. %. In yet another embodiment, the combined amount of scandium plus zirconium in a new 5xxx aluminum alloy is not greater than 0.16 wt. %, i.e., (wt. % Sc)+(wt. % Zr)≤0.16 wt. %.

As noted above, the new 5xxx aluminum alloys may include up to 0.8 wt. % Zn. Zinc may facilitate, for instance, improved corrosion resistance. In one embodiment, a new 5xxx aluminum alloy includes at least 0.15 wt. % Zn. In another embodiment, a new 5xxx aluminum alloy includes at least 0.2 wt. % Zn. In yet another embodiment, a new 5xxx aluminum alloy includes at least 0.25 wt. % Zn. In another embodiment, a new 5xxx aluminum alloy includes at least 0.3 wt. % Zn. In yet another embodiment, a new 5xxx aluminum alloy includes at least 0.35 wt. % Zn. In one embodiment, a new 5xxx aluminum alloy includes not greater than 0.75 wt. % Zn. In another embodiment, a new 5xxx aluminum alloy includes not greater than 0.7 wt. % Zn. In yet another embodiment, a new 5xxx aluminum alloy includes not greater than 0.65 wt. % Zn. In another embodiment, a new 5xxx aluminum alloy includes not greater than 0.6 wt. % Zn. In yet another embodiment, a new 5xxx aluminum alloy includes not greater than 0.55 wt. % Zn. In another embodiment, a new 5xxx aluminum alloy includes not greater than 0.5 wt. % Zn. In yet another embodiment, a new 5xxx aluminum alloy includes not greater than 0.45 wt. % Zn.

As noted above, the new 5xxx aluminum alloys may include up to 0.2 wt. % Cu. Copper is generally less preferred as it may negatively impact, for instance, corrosion resistance. In one embodiment, a new 5xxx aluminum alloy includes not greater than 0.15 wt. % Cu. In another embodiment, a new 5xxx aluminum alloy includes not greater than 0.10 wt. % Cu. In yet another embodiment, a new 5xxx aluminum alloy includes not greater than 0.08 wt. % Cu. In another embodiment, a new 5xxx aluminum alloy includes not greater than 0.05 wt. % Cu. In yet another embodiment, a new 5xxx aluminum alloy includes not greater than 0.04 wt. % Cu. In another embodiment, a new 5xxx aluminum alloy includes not greater than 0.03 wt. % Cu. In yet another embodiment, a new 5xxx aluminum alloy includes not greater than 0.02 wt. % Cu. In another embodiment, a new 5xxx aluminum alloy includes not greater than 0.01 wt. % Cu. In yet another embodiment, a new 5xxx aluminum alloy includes not greater than 0.005 wt. % Cu.

As noted above, the new 5xxx aluminum alloys may include up to 0.20 wt. % Cr. Chromium may be used in addition to or as a substitute (in whole or in part) for scandium and/or zirconium. In one approach, a 5xxx aluminum alloy includes from 0.05 to 0.20 wt. % Cr. In another approach, a 5xxx aluminum alloy includes not greater than 0.15 wt. % Cr. In one embodiment, a 5xxx aluminum alloy includes not greater than 0.10 wt. % Cr. In another embodiment, a 5xxx aluminum alloy includes not greater than 0.08 wt. % Cr. In yet another embodiment, a 5xxx aluminum alloy includes not greater than 0.05 wt. % Cr. In another embodiment, a 5xxx aluminum alloy includes not greater than 0.04 wt. % Cr. In yet another embodiment, a 5xxx aluminum alloy includes not greater than 0.03 wt. % Cr. In another embodiment, a 5xxx aluminum alloy includes not greater than 0.02 wt. % Cr. In yet another embodiment, a 5xxx aluminum alloy includes not greater than 0.01 wt. % Cr. In another embodiment, a 5xxx aluminum alloy includes not greater than 0.005 wt. % Cr.

As noted above, the new 5xxx aluminum alloys may include up to 0.20 wt. % V. Vanadium may be used in addition to or as a substitute (in whole or in part) for scandium and/or zirconium. In one approach, a 5xxx aluminum alloy includes from 0.05 to 0.20 wt. % V. In another approach, a 5xxx aluminum alloy includes not greater than 0.15 wt. % V. In one embodiment, a 5xxx aluminum alloy includes not greater than 0.10 wt. % V. In another embodiment, a 5xxx aluminum alloy includes not greater than 0.08 wt. % V. In yet another embodiment, a 5xxx aluminum alloy includes not greater than 0.05 wt. % V. In another embodiment, a 5xxx aluminum alloy includes not greater than 0.04 wt. % V. In yet another embodiment, a 5xxx aluminum alloy includes not greater than 0.03 wt. % V. In another embodiment, a 5xxx aluminum alloy includes not greater than 0.02 wt. % V. In yet another embodiment, a 5xxx aluminum alloy includes not greater than 0.01 wt. % V. In another embodiment, a 5xxx aluminum alloy includes not greater than 0.005 wt. % V.

As noted above, a new 5xxx aluminum alloy may include up to 0.15 wt. % Ti. Titanium may facilitate, for instance, grain refining. In one embodiment, a new 5xxx aluminum alloy includes at least 0.005 wt. % Ti. In another embodiment, a new 5xxx aluminum alloy includes at least 0.01 wt. % Ti. In yet another embodiment, a new 5xxx aluminum alloy includes at least 0.02 wt. % Ti. In another embodiment, a new 5xxx aluminum alloy includes at least 0.03 wt. % Ti. In yet another embodiment, a new 5xxx aluminum alloy includes at least 0.04 wt. % Ti. In another embodiment, a new 5xxx aluminum alloy includes at least 0.05 wt. % Ti. In one embodiment, a new 5xxx aluminum alloy includes not greater than 0.12 wt. % Ti. In another embodiment, a new 5xxx aluminum alloy includes not greater than 0.10 wt. % Ti.

As noted above, a new 5xxx aluminum alloy may include up to 0.10 wt. % Fe. Iron is a normal impurity in primary aluminum. In one embodiment, a new 5xxx aluminum alloy includes at least 0.01 wt. % Fe. In another embodiment, a new 5xxx aluminum alloy includes at least 0.03 wt. % Fe. In one embodiment, a new 5xxx aluminum alloy includes not greater than 0.09 wt. % Fe. In another embodiment, a new 5xxx aluminum alloy includes not greater than 0.08 wt. % Fe. In yet another embodiment, a new 5xxx aluminum alloy includes not greater than 0.07 wt. % Fe. In another embodiment, a new 5xxx aluminum alloy includes not greater than 0.06 wt. % Fe.

As noted above, a new 5xxx aluminum alloy may include up to 0.10 wt. % Si. Silicon is a normal impurity in primary aluminum. In one embodiment, anew 5xxx aluminum alloy includes at least 0.01 wt. % Si. In another embodiment, a new 5xxx aluminum alloy includes at least 0.03 wt. % Si. In one embodiment, a new 5xxx aluminum alloy includes not greater than 0.09 wt. % Si. In another embodiment, a new 5xxx aluminum alloy includes not greater than 0.08 wt. % Si. In yet another embodiment, a new 5xxx aluminum alloy includes not greater than 0.07 wt. % Si. In another embodiment, a new 5xxx aluminum alloy includes not greater than 0.06 wt. % Si.

As noted above, the new 5xxx aluminum alloys generally include the stated alloying ingredients, the balance being aluminum, optional incidental elements, and impurities. As used herein, "incidental elements" means those elements or materials, other than the above listed elements, that may optionally be added to the alloy to assist in the production of the alloy. Examples of incidental elements include casting aids, such as grain refiners and deoxidizers. Optional incidental elements may be included in the alloy in a cumulative amount of up to 1.0 wt. %. As one non-limiting example, one or more incidental elements may be added to the alloy during casting to reduce or restrict (and in some instances eliminate) ingot cracking due to, for example, oxide fold, pit and oxide patches. These types of incidental elements are generally referred to herein as deoxidizers. Examples of some deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of about 0.001-0.03 wt % or about 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm. Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

The new 5xxx aluminum alloys may contain low amounts of impurities (excluding iron and silicon, which are separately defined). In one embodiment, a new 5xxx aluminum alloy includes not greater than 0.15 wt. %, in total, of the impurities, and wherein the aluminum alloy includes not greater than 0.05 wt. % of each of the impurities. In another embodiment, a new 5xxx aluminum alloy includes not greater than 0.10 wt. %, in total, of the impurities, and wherein the aluminum alloy includes not greater than 0.03 wt. % of each of the impurities.

The new 5xxx aluminum alloys are generally substantially free of lithium, i.e., lithium is included only as an impurity, and generally at less than 0.04 wt. % Li, or less than 0.01 wt. % Li. The new 5xxx aluminum alloys are generally substantially free of silver, i.e., silver is included only as an impurity, and generally at less than 0.04 wt. % Ag, or less than 0.01 wt. % Ag. The new 5xxx aluminum alloys are generally substantially free of lead, i.e., lead is included only as an impurity, and generally at less than 0.04 wt. % Pb, or less than 0.01 wt. % Pb. The new 5xxx aluminum alloys are generally substantially free of cadmium, i.e., cadmium is included only as an impurity, and generally at less than 0.04 wt. % Cd, or less than 0.01 wt. % Cd.

II. METHODS OF PRODUCTION

The new 5xxx aluminum alloys may be useful in a variety of product forms, including ingot or billet, and wrought product forms. In one embodiment, any of the new 5xxx aluminum alloys described in Section I is cast (e.g., direct chill cast or continuously cast) into an ingot, billet, or strip. After casting, the ingot/billet/strip may be worked (hot and/or cold worked) into the appropriate product form (sheet, plate, extrusion, or forging).

In one approach embodiment, the new 5xxx aluminum alloy is produced as a rolled sheet product having a thickness of from 0.5 to 8.0 mm. For instance, a method may include casting an ingot of any of the aluminum alloys described in Section I, above, followed by homogenization, scalping, and lathing or peeling (if needed). The ingot may then be hot rolled to an intermediate or final gauge. If the hot rolling results in an intermediate gauge product, cold rolling may be used to complete the rolling process and achieve the final gauge product. Intermediate anneals may be used between cold rolling steps, if needed, to facilitate the cold rolling. After the rolling is completed, the product is then generally subject to a final anneal. Final anneal conditions are described in detail in the Examples section, below. Additional details regarding potential methods of production are also described in detail in the Examples section, below.

III. MICROSTRUCTURE

The new 5xxx aluminum alloy products generally realize a unique microstructure. For instance, as noted above, anew 5xxx aluminum alloy product may include at least 0.5 vol. % of beta phase particles. The beta phase particles may define an aspect ratio (AR) distribution. In one embodiment, an AR99 of the beta phase particles is not greater than 10.0. The beta phase particles also may define a beta phase particle size distribution. In one embodiment, a D99 of the beta phase particle size distribution is not greater than 3.0 micrometers. The amount, size and aspect ratios of the beta phase particles is to be determined by the Beta Phase Particle Measurement Procedure, described herein.

In one embodiment, an AR99 of the new 5xxx aluminum alloy sheet product is not greater than 9.0. In another embodiment, an AR99 of the new 5xxx aluminum alloy sheet product is not greater than 8.0. In yet another embodiment, an AR99 of the new 5xxx aluminum alloy sheet product is not greater than 7.0. In another embodiment, an AR99 of the new 5xxx aluminum alloy sheet product is not greater than 6.0. In yet another embodiment, an AR99 of the new 5xxx aluminum alloy sheet product is not greater than 5.0. In another embodiment, an AR99 of the new 5xxx aluminum alloy sheet product is not greater than 4.75. In yet another embodiment, an AR99 of the new 5xxx aluminum alloy sheet product is not greater than 4.5. In another embodiment, an AR99 of the new 5xxx aluminum alloy sheet product is not greater than 4.25. In yet another embodiment, an AR99 of the new 5xxx aluminum alloy sheet product is not greater than 4.0. In another embodiment, an AR99 of the new 5xxx aluminum alloy sheet product is not greater than 3.75. In yet another embodiment, an AR99 of the new 5xxx aluminum alloy sheet product is not greater than 3.5. In another embodiment, an AR99 of the new 5xxx aluminum alloy sheet product is not greater than 3.3.

In one embodiment, the beta phase particles define an aspect ratio (AR) distribution, and an AR90 of the new 5xxx aluminum alloy sheet product is not greater than 8.0. In another embodiment, an AR90 of the new 5xxx aluminum alloy sheet product is not greater than 7.0. In yet another embodiment, an AR90 of the new 5xxx aluminum alloy sheet product is not greater than 6.0. In another embodiment, an AR90 of the new 5xxx aluminum alloy sheet product is not greater than 5.0. In yet another embodiment, an AR90 of the new 5xxx aluminum alloy sheet product is not greater than 4.5. In another embodiment, an AR90 of the new 5xxx aluminum alloy sheet product is not greater than 4.0. In yet another embodiment, an AR90 of the new 5xxx aluminum alloy sheet product is not greater than 3.5. In yet another embodiment, an AR90 of the new 5xxx aluminum alloy sheet product is not greater than 3.0. In another embodiment, an AR90 of the new 5xxx aluminum alloy sheet product is not greater than 2.75. In yet another embodiment, an AR90 of the new 5xxx aluminum alloy sheet product is not greater than 2.5. In another embodiment, an AR90 of the new 5xxx aluminum alloy sheet product is not greater than 2.25.

In one embodiment, the beta phase particles define an aspect ratio (AR) distribution, and an AR50 of the new 5xxx aluminum alloy sheet product is not greater than 6.0. In another embodiment, an AR50 of the new 5xxx aluminum alloy sheet product is not greater than 5.0. In yet another embodiment, an AR50 of the new 5xxx aluminum alloy sheet product is not greater than 4.5. In another embodiment, an AR50 of the new 5xxx aluminum alloy sheet product is not greater than 4.0. In yet another embodiment, an AR50 of the new 5xxx aluminum alloy sheet product is not greater than 3.5. In another embodiment, an AR50 of the new 5xxx aluminum alloy sheet product is not greater than 3.0. In yet another embodiment, an AR50 of the new 5xxx aluminum alloy sheet product is not greater than 2.75. In yet another embodiment, an AR50 of the new 5xxx aluminum alloy sheet product is not greater than 2.5. In another embodiment, an AR50 of the new 5xxx aluminum alloy sheet product is not greater than 2.25. In yet another embodiment, an AR50 of the new 5xxx aluminum alloy sheet product is not greater than 2.0. In another embodiment, an AR50 of the new 5xxx aluminum alloy sheet product is not greater than 1.75. In yet another embodiment, an AR50 of the new 5xxx aluminum alloy sheet product is not greater than 1.5.

As noted above, the beta phase particles may define a beta phase particle size distribution, and a D99 of the beta phase particle size distribution may be not greater than 3.0 micrometers. In one embodiment, a D99 of the beta phase particle size distribution is not greater than 2.8 micrometers. In another embodiment, a D99 of the beta phase particle size distribution is not greater than 2.6 micrometers. In yet another embodiment, a D99 of the beta phase particle size distribution is not greater than 2.4 micrometers. In another embodiment, a D99 of the beta phase particle size distribution is not greater than 2.2 micrometers. In yet another embodiment, a D99 of the beta phase particle size distribution is not greater than 2.0 micrometers. In another embodiment, a D99 of the beta phase particle size distribution is not greater than 1.8 micrometers. In yet another embodiment, a D99 of the beta phase particle size distribution is not greater than 1.6 micrometers. In another embodiment, a D99 of the beta phase particle size distribution is not greater than 1.4 micrometers. In yet another embodiment, a D99 of the beta phase particle size distribution is not greater than 1.2 micrometers. In another embodiment, a D99 of the beta phase particle size distribution is not greater than 1.0 micrometers. In yet another embodiment, a D99 of the beta phase particle size distribution is not greater than 0.9 micrometers. In another embodiment, a D99 of the beta phase particle size distribution is not greater than 0.8 micrometers.

In one embodiment, the beta phase particles define a beta phase particle size distribution, and a D90 of the beta phase particle size distribution is not greater than 2.0 micrometers. In one embodiment, a D90 of the beta phase particle size distribution is not greater than 1.9 micrometers. In another embodiment, a D90 of the beta phase particle size distribution is not greater than 1.8 micrometers. In yet another embodiment, a D90 of the beta phase particle size distribution is not greater than 1.7 micrometers. In another embodiment, a D90 of the beta phase particle size distribution is not greater than 1.6 micrometers. In yet another embodiment, a D90 of the beta phase particle size distribution is not greater than 1.5 micrometers. In another embodiment, a D90 of the beta phase particle size distribution is not greater than 1.4 micrometers. In yet another embodiment, a D90 of the beta phase particle size distribution is not greater than 1.3 micrometers. In another embodiment, a D90 of the beta phase particle size distribution is not greater than 1.2 micrometers. In yet another embodiment, a D90 of the beta phase particle size distribution is not greater than 1.1 micrometers. In another embodiment, a D90 of the beta phase particle size distribution is not greater than 1.0 micrometers. In yet another embodiment, a D90 of the beta phase particle size distribution is not greater than 0.9 micrometers. In another embodiment, a D90 of the beta phase particle size distribution is not greater than 0.8 micrometers. In yet another embodiment, a D90 of the beta phase particle size distribution is not greater than 0.7 micrometers. In another embodiment, a D90 of the beta phase particle size distribution is not greater than 0.6 micrometers.

In one embodiment, the beta phase particles define a beta phase particle size distribution, and a D50 of the beta phase particle size distribution is not greater than 1.5 micrometers. In one embodiment, a D50 of the beta phase particle size distribution is not greater than 1.4 micrometers. In another embodiment, a D50 of the beta phase particle size distribution is not greater than 1.3 micrometers. In yet another embodiment, a D50 of the beta phase particle size distribution is not greater than 1.2 micrometers. In another embodiment, a D50 of the beta phase particle size distribution is not greater than 1.1 micrometers. In yet another embodiment, a D50 of the beta phase particle size distribution is not greater than 1.0 micrometers. In another embodiment, a D50 of the beta phase particle size distribution is not greater than 0.9 micrometers. In yet another embodiment, a D50 of the beta phase particle size distribution is not greater than 0.8 micrometers. In another embodiment, a D50 of the beta phase particle size distribution is not greater than 0.7 micrometers. In yet another embodiment, a D50 of the beta phase particle size distribution is not greater than 0.6 micrometers. In another embodiment, a D50 of the beta phase particle size distribution is not greater than 0.5 micrometers. In yet another embodiment, a D50 of the beta phase particle size distribution is not greater than 0.4 micrometers. In another embodiment, a D50 of the beta phase particle size distribution is not greater than 0.3 micrometers.

In one embodiment, the beta phase particles define a beta phase particle size distribution, and a D10 of the beta phase particle size distribution is at least 0.01 micrometers. In one embodiment, a D10 of the beta phase particle size distribution is at least 0.02 micrometers. In another embodiment, a D10 of the beta phase particle size distribution is at least 0.03 micrometers. In yet another embodiment, a D10 of the beta phase particle size distribution is at least 0.04 micrometers. In another embodiment, a D10 of the beta phase particle size distribution is at least 0.05 micrometers. In yet another embodiment, a D10 of the beta phase particle size distribution is at least 0.06 micrometers. In another embodiment, a D10 of the beta phase particle size distribution is at least 0.07 micrometers. In yet another embodiment, a D10 of the beta phase particle size distribution is at least 0.08 micrometers. In another embodiment, a D10 of the beta phase particle size distribution is at least 0.09 micrometers. In yet another embodiment, a D10 of the beta phase particle size distribution is at least 0.10 micrometers. In another embodiment, a D10 of the beta phase particle size distribution is at least 0.11 micrometers. In yet another embodiment, a D10 of the beta phase particle size distribution is at least 0.12 micrometers. In another embodiment, a D10 of the beta phase particle size distribution is at least 0.13 micrometers. In yet another embodiment, a D10 of the beta phase particle size distribution is at least 0.14 micrometers.

In one embodiment, a new 5xxx sheet product is unrecrystallized.

IV. PROPERTIES

As noted above, the new 5xxx aluminum alloys may realize an improved combination of properties, such as an improved combination of two or more of strength, strength retention, ductility (elongation), damage tolerance and corrosion resistance.

In one embodiment, a new 5xxx aluminum alloy sheet product has a thickness of from 0.5 to 8.0 mm and realizes a tensile yield strength (L or LT) of at least 300 MPa. In another embodiment, a new 5xxx aluminum alloy sheet product has a thickness of from 0.5 to 8.0 mm and realizes a tensile yield strength (L or LT) of at least 310 MPa. In yet another embodiment, anew 5xxx aluminum alloy sheet product has a thickness of from 0.5 to 8.0 mm and realizes a tensile yield strength (L or LT) of at least 320 MPa. In another embodiment, a new 5xxx aluminum alloy sheet product has a thickness of from 0.5 to 8.0 mm and realizes a tensile yield strength (L or LT) of at least 330 MPa. In yet another embodiment, a new 5xxx aluminum alloy sheet product has a thickness of from 0.5 to 8.0 mm and realizes a tensile yield strength (L or LT) of at least 340 MPa. In another embodiment, a new 5xxx aluminum alloy sheet product has a thickness of from 0.5 to 8.0 mm and realizes a tensile yield strength (L or LT) of at least 350 MPa.

In one embodiment, a 5xxx aluminum sheet product has high strength retention, realizing a strength (TYS) drop of not greater than 50 MPa from the final annealed condition to the creep annealed condition. In another embodiment, a 5xxx aluminum sheet product realizes a strength (TYS) drop of not greater than 40 MPa from the final annealed condition to the creep annealed condition. In yet another embodiment, a 5xxx aluminum sheet product realizes a strength (TYS) drop of not greater than 30 MPa from the final annealed condition to the creep annealed condition. In another embodiment, a 5xxx aluminum sheet product realizes a strength (TYS) drop of not greater than 20 MPa from the final annealed condition to the creep annealed condition.

In one embodiment, a new 5xxx aluminum alloy sheet product has a thickness of from 0.5 to 8.0 mm and realizes an elongation (L or LT) of at least 5%. In another embodiment, a new 5xxx aluminum alloy sheet product has a thickness of from 0.5 to 8.0 mm and realizes an elongation (L or LT) of at least 6%. In yet another embodiment, a new 5xxx aluminum alloy sheet product has a thickness of from 0.5 to 8.0 mm and realizes an elongation (L or LT) of at least 7%. In another embodiment, a new 5xxx aluminum alloy sheet product has a thickness of from 0.5 to 8.0 mm and realizes an elongation (L or LT) of at least 8%. In yet another embodiment, a new 5xxx aluminum alloy sheet product has a thickness of from 0.5 to 8.0 mm and realizes an elongation (L or LT) of at least 9%. In another embodiment, a new 5xxx aluminum alloy sheet product has a thickness of from 0.5 to 8.0 mm and realizes an elongation (L or LT) of at least 10%. In yet another embodiment, a new 5xxx aluminum alloy sheet product has a thickness of from 0.5 to 8.0 mm and realizes an elongation (L or LT) of at least 11%. In another embodiment, a new 5xxx aluminum alloy sheet product has a thickness of from 0.5 to 8.0 mm and realizes an elongation (L or LT) of at least 12%. In yet another embodiment, a new 5xxx aluminum alloy sheet product has a thickness of from 0.5 to 8.0 mm and realizes an elongation (L or LT) of at least 13%.

In one embodiment, a new 5xxx aluminum alloy sheet product has a thickness of from 0.5 to 8.0 mm and realizes a mass loss of not greater than 25 mg/cm$^2$ in the sensitized condition when tested in accordance with ASTM G67. In another embodiment, a new 5xxx aluminum alloy sheet product has a thickness of from 0.5 to 8.0 mm and realizes a mass loss of not greater than 20 mg/cm$^2$ in the sensitized condition when tested in accordance with ASTM G67. In yet another embodiment, a new 5xxx aluminum alloy sheet product has a thickness of from 0.5 to 8.0 mm and realizes a mass loss of not greater than 15 mg/cm$^2$ in the sensitized condition when tested in accordance with ASTM G67.

As used herein, the "sensitized condition" means the 5xxx aluminum alloy product is held for 1 week (7 days) at 248° F. (120° C.).

In one embodiment, a new 5xxx aluminum alloy sheet product has a thickness of from 0.5 to 8.0 mm and realizes an exfoliation rating of at least EB when tested in accordance with ASTM G66-99(2018). In another embodiment, a new 5xxx aluminum alloy sheet product has a thickness of from 0.5 to 8.0 mm and realizes an exfoliation rating of at least EA when tested in accordance with ASTM G66-99 (2018). In yet another embodiment, a new 5xxx aluminum alloy sheet product has a thickness of from 0.5 to 8.0 mm and realizes an exfoliation rating of at least P when tested in accordance with ASTM G66-99(2018).

In one embodiment, a new 5xxx aluminum alloy sheet product has a thickness of from 0.5 to 8.0 mm and realizes, when tested at a gauge of 2.5 mm, a plane-stress T-L fracture toughness (Kc) of at least 150 MPa√m, when tested in accordance with ASTM E561 on an M(T) specimen, wherein W=760 mm, B=2.5 mm, and 2a0=253 mm. In another embodiment, the new 5xxx aluminum alloy sheet product has a thickness of from 0.5 to 8.0 mm and realizes, when tested at a gauge of 2.5 mm, a plane-stress T-L fracture toughness (Kc) of at least 160 MPa√m. In yet another embodiment, the new 5xxx aluminum alloy sheet product has a thickness of from 0.5 to 8.0 mm and realizes, when tested at a gauge of 2.5 mm, a plane-stress T-L fracture toughness (Kc) of at least 170 MPa√m. In another embodiment, the new 5xxx aluminum alloy sheet product has a thickness of from 0.5 to 8.0 mm and realizes, when tested at a gauge of 2.5 mm, a plane-stress T-L fracture toughness (Kc) of at least 180 MPa√m.

In one embodiment, a new 5xxx aluminum alloy sheet product realizes at least equivalent performance relative to a conventional AA2524 alloy in at least one of the following categories:

ASTM B117 (Neutral Salt Spray) performance
ASTM G85 A2 (MASTMAASIS) performance
ASTM D2247 (Condensing Humidity) performance
ASTM D3330 (Adhesion) performance; and
ASTM F2111 (Intergranular Attack) performance.

In another embodiment, a new 5xxx aluminum alloy sheet product realizes at least equivalent performance relative to a conventional AA2524 alloy in at least two of the above categories. In yet another embodiment, a new 5xxx aluminum alloy sheet product realizes at least equivalent performance relative to a conventional AA2524 alloy in at least three of the above categories. In another embodiment, a new 5xxx aluminum alloy sheet product realizes at least equivalent performance relative to a conventional AA2524 alloy in at least four of the above categories. In another embodiment, a new 5xxx aluminum alloy sheet product realizes at least equivalent performance relative to a conventional AA2524 alloy in all of the above categories.

In one embodiment, a new 5xxx aluminum alloy sheet product performs better than a conventional AA2524 alloy in at least one of the above categories (e.g., ASTM G85 A2, ASTM F2111) while achieving at least equivalent performance in all the other categories. In one embodiment, a new 5xxx aluminum alloy sheet product performs better than a conventional AA2524 alloy in at least two of the above categories (e.g., ASTM G85 A2, ASTM F2111) while achieving at least equivalent performance in all the other categories.

As used herein, a "conventional AA2524" alloy is a bare (unclad) AA2524-T3 aluminum alloy sheet product of equivalent gauge to the new 5xxx aluminum alloy sheet product.

In another embodiment, a new 5xxx aluminum alloy sheet product realizes at least equivalent performance relative to a conventional Alcad AA2524 alloy in at least one of the following categories:

ASTM B117 (Neutral Salt Spray) performance
ASTM G85 A2 (MASTMAASIS) performance
ASTM D2247 (Condensing Humidity) performance
ASTM D3330 (Adhesion) performance; and
ASTM D2803 (Filiform) performance.

In another embodiment, a new 5xxx aluminum alloy sheet product realizes at least equivalent performance relative to a conventional Alcad AA2524 alloy in at least two of the above categories. In yet another embodiment, a new 5xxx aluminum alloy sheet product realizes at least equivalent performance relative to a conventional Alcad AA2524 alloy in at least three of the above categories. In another embodiment, a new 5xxx aluminum alloy sheet product realizes at least equivalent performance relative to a conventional Alcad AA2524 alloy in at least four of the above categories. In another embodiment, a new 5xxx aluminum alloy sheet product realizes at least equivalent performance relative to a conventional Alcad AA2524 alloy in all of the above categories.

In one embodiment, a new 5xxx aluminum alloy sheet product performs better than a conventional Alcad AA2524 alloy in at least one of the above categories (e.g., ASTM B117) while achieving at least equivalent performance in all the other categories.

As used herein, a "conventional Alcad AA2524" alloy is AA2524-T3 aluminum alloy sheet product of equivalent gauge to the new 5xxx aluminum alloy sheet product having an AA1050 (or similar) cladding thereon.

V. PRODUCT APPLICATIONS

The new 5xxx aluminum alloys described herein may be used in a variety of product applications, such aerospace (e.g., fuselage sheet, fuselage bulkhead, other damage tolerant double curvature panel requiring complex forming operations), space and defense applications, among others.

VI. DEFINITIONS

"Wrought aluminum alloy product" means an aluminum alloy product that is hot worked after casting, and includes rolled products (sheet or plate), forged products, and extruded products.

"Forged aluminum alloy product" means a wrought aluminum alloy product that is either die forged or hand forged.

"Hot working" means working the aluminum alloy product at elevated temperature, generally at least 250° F. Strain-hardening is restricted/avoided during hot working, which generally differentiates hot working from cold working.

"Cold working" means working the aluminum alloy product at temperatures that are not considered hot working temperatures, generally below about 250° F. (e.g., at ambient).

Temper definitions are per ANSI H35.1 (2009), entitled "American National Standard Alloy and Temper Designation Systems for Aluminum," published by The Aluminum Association.

Strength and elongation are measured in accordance with ASTM E8/E8M-16a and B557-15.

As used in this patent application, "aluminum alloy sheet product" means a product having a thickness of from 0.5 mm to 8.0 mm. In one embodiment, an aluminum alloy sheet product has a thickness of from 1.0 to 6.35 mm. In another embodiment, an aluminum alloy sheet product has a thickness of from 1.0 to 4.0 mm. In yet another embodiment, an aluminum alloy sheet product has a thickness of from 2.0 to 3.0 mm.

VII. MISCELLANEOUS

These and other aspects, advantages, and novel features of this new technology are set forth in part in the description that follows and will become apparent to those skilled in the art upon examination of the following description and figures or may be learned by practicing one or more embodiments of the technology provided for by the present disclosure.

The figures constitute a part of this specification and include illustrative embodiments of the present disclosure and illustrate various objects and features thereof. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though they may. Furthermore, the phrases "in another embodiment" and "in some other embodiments" as used herein do not necessarily refer to a different embodiment, although they may. Thus, various embodiments of the invention may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references, unless the context clearly dictates otherwise. The meaning of "in" includes "in" and "on", unless the context clearly dictates otherwise.

Various ones of the unique aspects noted hereinabove may be combined to yield various new 5xxx aluminum alloy products having an improved combination of properties. Additionally, these and other aspects and advantages, and novel features of this new technology are set forth in part in the description that follows and will become apparent to those skilled in the art upon examination of the following description and figures, or may be learned by practicing one or more embodiments of the technology provided for by the present disclosure.

BRIEF DESCRIPTION OF THE DRAWINGS

FIG. 1 is a graph illustrating the performance of Example 1 alloys versus prior art alloys.

DETAILED DESCRIPTION

Example 1—Plant Trial

Figure 3:
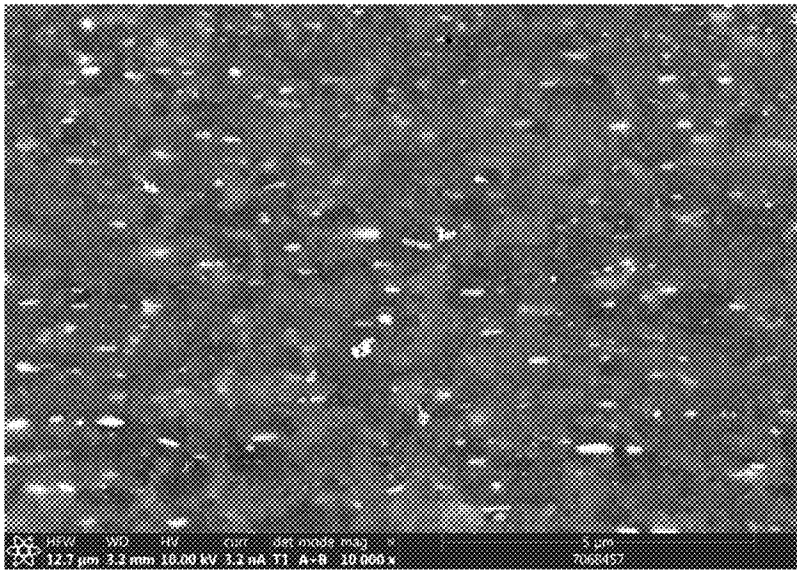
FIG. 3 is an SEM micrograph of a new 5xxx aluminum alloy subjected to a final anneal of 325° C. for 4 hours.

A new 5xxx aluminum alloy was cast as an industrial size ingot. The composition of this ingot is provided Table 1a, below (all values in weight percent).

TABLE 1a

Example 1 Alloy Composition*

| Alloy | Si | Fe | Cu | Mn | Mg | Cr | Zn | Ti | Sc | Zr |
|---|---|---|---|---|---|---|---|---|---|---|
| 1 | 0.03 | 0.06 | — | 0.90 | 4.34 | — | 0.39 | 0.05 | 0.10 | 0.06 |

*The alloy contained the listed elements, the balance being aluminum and impurities, where the impurities did not exceed more than 0.05 wt. % each, and where the alloy contains not more than 0.15 wt. %, in total, of the impurities.

The ingot was then scalped, homogenized and then hot rolled to an intermediate gauge of 0.202 inch (5.131 mm). The intermediate gauge material was then cooled to room temperature and then cold rolled to a second intermediate gauge of 0.140 inch (3.556 mm) after which the material was annealed at about 218° C. (425° F.) for 14 hours. The material was then cooled to room temperature and then cold rolled again to a final gauge of 0.098 inch (2.489 mm). The final gauge material was then annealed at 232° C. (450° F.) for both 2 and 16 hours. The mechanical properties of final gauge material were then tested, the results of which are shown in Table 1b, below.

TABLE 1b

Mechanical Properties of Alloy 1

| Test Direction | Final Anneal | UTS (MPa) | TYS (MPa) | Elong. (%) |
|---|---|---|---|---|
| L | 2 hours at 232° C. | 418 | 348 | 9.4 |
| LT | 16 hours at 232° C. | 425 | 350 | 12 |

NOTE: As used herein, "final anneal" means the first anneal that follows the final cold rolling step. Other anneals may be completed after the "final anneal," such as a creep forming anneal conducted by an aerospace manufacturer, but those anneals are not considered the "final anneal" because they are not the first anneal following the final cold rolling step.

After the final anneal step, the materials were subjected to forming annealing conditions, i.e., conditions that would normally be used by an aerospace manufacturer when forming the material into a fuselage sheet or other formed aerospace product. The mechanical properties of the alloys were then again measured, the results of which are shown in Table 2, below.

TABLE 2

Mechanical Properties of Alloy 1 - Final Anneal + Creep Anneal Condition

| Test Direction | Final Anneal | Forming Anneal | UTS (MPa) | TYS (MPa) | Elong. (%) |
|---|---|---|---|---|---|
| L | 2 hours at 232° C. | 2 hours at 325° C. | 410 | 320 | 11.5 |
| L | 2 hours at 232° C. | 4 hours at 325° C. | 410 | 319 | 12.5 |
| LT | 16 hours at 232° C. | 4 hours at 325° C. | 413 | 327 | 17.5 |
| L | 16 hours at 232° C. | 4 hours at 325° C. | 426 | 324 | 11.0 |

As shown, despite having low levels of scandium and zirconium, Alloy 1 is surprisingly able to achieve excellent mechanical properties. Moreover, the alloy is able to substantially retain its strength even after creep annealing.

FIG. 1 illustrates the properties of Alloy 1, in both conditions, as compared to the properties of alloys of having 3.5-4.5 wt. % Mg and a final gauge of 1-4 mm from U.S. Patent Application Publication No. 2009/0226343 and U.S. Patent Application Publication No. 2019/0249285. The alloys of US2009/0226343 were final annealed at 325° C. for 2 hours. The alloys of US2019/0249285 were final annealed at 275° C., 325° C., or 375° C. for 2 hours. As shown, even at very low levels of Sc+Zr, Alloy 1 realizes high strength in both the final anneal and creep anneal conditions.

Corrosion testing of Alloy 1 was also completed, the results of which are shown in Table 3, below. Prior to testing, all samples were sensitized by heating to 120° C. (248° F.) and holding at this temperature for one week.

TABLE 3

Corrosion Resistance Properties of Alloy 1

| Final Anneal | Additional Anneal | Sensitization Before Corrosion Testing | ASTM G67 Mass Loss ($mg/cm^2$) | ASTM G66 Asset Rating |
|---|---|---|---|---|
| 2 hours at 232° C. | None | Holding at | 20 | EA |
| 16 hours at 232° C. | None | 120° C. | 18 | EA |
| 2 hours at 325° C. | None | for 7 days | 43 | ED |
| 4 hours at 325° C. | None | | 42 | ED |
| 16 hours at 232° C. | 4 hrs at 325° C. | | 43 | ED |
| 16 hours at 232° C. | 4 hrs at 325° C. + 16 hrs at 232° C. | | 15 | EA |

It is hypothesized that a proper final anneal facilitates an improved combination of properties, such as an improved combination of two or more of strength, strength retention (after creep anneal), corrosion resistance, and ductility, among others. The final anneal may, for instance, facilitate disruption of precipitate phases along the grain boundaries. In one approach, the final anneal is conducted at a temperature of from 145-278° C. (293-532° F.). In one embodiment, the final anneal temperature is not greater than 270° C. (518° F.). In another embodiment, the final anneal temperature is not greater than 265° C. (509° F.). In yet another embodiment, the final anneal temperature is not greater than 260° C. (500° F.). In another embodiment, the final anneal temperature is not greater than 255° C. (491° F.). In yet another embodiment, the final anneal temperature is not greater than 250° C. (482° F.). In another embodiment, the final anneal temperature is not greater than 245° C. (473° F.). In yet another embodiment, the final anneal temperature is not greater than 240° C. (464° F.). In another embodiment, the final anneal temperature is not greater than 235° C. (455° F.). In yet another embodiment, the final anneal temperature is not greater than 232° C. (450° F.).

In one embodiment, the final anneal temperature is at least 150° C. (302° F.). In another embodiment, the final anneal temperature is at least 160° C. (320° F.). In yet another embodiment, the final anneal temperature is at least 170° C. (338° F.). In another embodiment, the final anneal temperature is at least 180° C. (356° F.). In yet another embodiment, the final anneal temperature is at least 190° C. (374° F.). In another embodiment, the final anneal temperature is at least 200° C. (392° F.). In yet another embodiment, the final anneal temperature is at least 205° C. (401° F.).

The final anneal should be conducted for a time sufficient to substantially disrupt the precipitate phases along the grain boundaries and/or for a time sufficient to develop applicable volumes of beta phase particles. In one embodiment, the anneal time is at least 5 minutes. In another embodiment, the anneal time is at least 15 minutes. In yet another embodiment, the anneal time is at least 30 minutes. In another embodiment, the anneal time is at least 60 minutes. In yet another embodiment, the anneal time is at least 2 hours. In another embodiment, the anneal time is at least 3 hours. In yet another embodiment, the anneal time is at least 4 hours, or more. The final anneal holding time is generally less than 100 hours, but is dependent on the temperature(s) used for the final anneal. Measurement of the anneal time begins when the temperature of the product is within 10° F. of its target anneal temperature.

In one embodiment, the final anneal temperature is not greater than "T-anneal(max)", wherein T-anneal(max) is the maximum final anneal temperature and is calculated as $116.3+(97.7*(\text{wt. \% Mg}))-(87*(\text{wt. \% Si}))+(11.6*(\text{wt. \% Mn}))+(105.8*(\text{wt. \% Zn}))-(5.04*(\text{wt. \% Mg})^2)-(41.7*(\text{wt. \% Zn})^2)$ in degrees Fahrenheit. As an example, the T-anneal (max) temperature of Alloy 1 of this Example 1 is 488.1° F., which is calculated as follows: $116.3+(97.7*(4.34))-(87*(0.03))+(11.6*(0.9))+(105.8*(0.39))-(5.04*(0.9)^2)-(41.7*(0.39)^2$. Annealing above the T-anneal(max) temperature may result in severely degraded properties, such as significantly degraded corrosion resistance.

In one embodiment, the final anneal temperature is at least 5° F. below the T-anneal(max) temperature. In another embodiment, the final anneal temperature is at least 10° F. below the T-anneal(max) temperature. In yet another embodiment, the final anneal temperature is at least 15° F. below the T-anneal(max) temperature. In another embodiment, the final anneal temperature is at least 20° F. below the T-anneal(max) temperature. In yet another embodiment, the final anneal temperature is at least 25° F. below the T-anneal (max) temperature. In another embodiment, the final anneal temperature is at least 30° F. below the T-anneal(max) temperature.

In one embodiment, the final anneal temperature is within 100° F. of the T-anneal(max) temperature; e.g., if T-anneal (max) is 475° F., then the final anneal temperature is not lower than 375° F. In another embodiment, the final anneal temperature is within 75° F. of the T-anneal(max) temperature; e.g., if T-anneal(max) is 475° F., then the final anneal temperature is not lower than 400° F. In yet another embodiment, the final anneal temperature is within 50° F. of the T-anneal(max) temperature; e.g., if T-anneal(max) is 475° F., then the final anneal temperature is not lower than 425° F. In another embodiment, the final anneal temperature is within 40° F. of the T-anneal(max) temperature; e.g., if T-anneal (max) is 475° F., then the final anneal temperature is not lower than 435° F.). The final anneal may be conducted at one or more temperatures within the range of [(T-anneal (max)−100° F.) to T-anneal(max)] and using one or more hold times.

Example 2—Beta Phase Particle Testing

Figure 2:
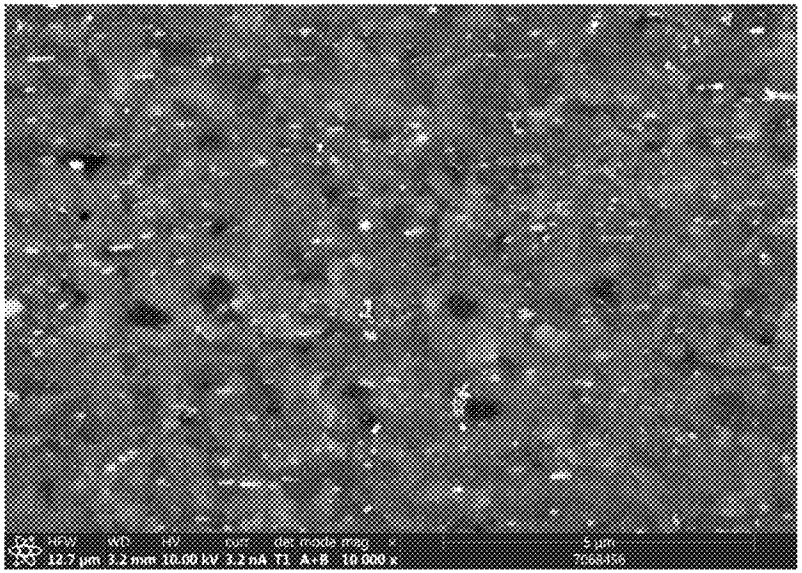
FIG. 2 is an SEM micrograph of a new 5xxx aluminum alloy subjected to a final anneal of 232° C. for 16 hours.

Two 5xxx aluminum alloy samples were analyzed to determine the amount of and size of any beta phase [$(Al, Zn)_3Mg_2$] particles included in the sample. Specifically, a first 5xxx aluminum alloy having a composition consistent with that of Example 1 was processed generally as per Example 1, using a final anneal of 16 hours at 232° C. A second 5xxx aluminum alloy having a composition consistent with that of Example 1 was processed generally as per Example 1, using a final anneal of 4 hours at 325° C. Samples of each alloy were then metallographically prepared and analyzed. As shown in FIG. 2, the first 5xxx aluminum alloy annealed at 232° C. for 16 hours contains a generally homogenous distribution of fine beta phase particles (in black). As shown in FIG. 3, the second 5xxx aluminum alloy annealed at 325° C. for 4 hours contains no beta phase particles.

The first 5xxx aluminum alloy was also analyzed per the Beta Phase Particle Measurement Procedure, described herein, except that internal proprietary software was used instead of the IMAGEPRO software disclosed in the procedure, the difference of which is expected to be negligible. The results of the image analysis are shown in Tables 4-6, below. As shown, the quantitative analysis of the Beta Phase Particle Measurement Procedure confirms that the first 5xxx aluminum alloy annealed at 232° C. for 16 hours includes a high volume of fine beta phase particles. The aspect ratio (1/w) of these particles is also low showing that the beta phase particles are generally equiaxed. It is believed this a high volume of fine, generally equiaxed, beta phase particles at least partially contributes to the unexpectedly improved combination of properties disclosed herein.

TABLE 4

Beta Phase Particles - By Thickness

| | Surface Results | T/4 Results | T/2 Results | Combined Results (S + T/4 + T/2) |
|---|---|---|---|---|
| Area Percent | 1.645 | 1.702 | 1.309 | 1.552 |
| Diameter (area-weighted) (micrometers) | 0.343 | 0.363 | 0.409 | 0.372 |
| Total Particles | 1733 | 1593 | 968 | 4294 |
| Aspect Ratio (mean) | 1.6 | 1.6 | 1.5 | 1.55 |

TABLE 5

Beta Phase Particles - Particle Size Distributions (Combined Results)

| | D10 | D50 | D90 | D99 | D99.9 | Min | Max |
|---|---|---|---|---|---|---|---|
| Diameter (area-weighted) (micrometers) | 0.14 | 0.30 | 0.54 | 0.80 | 1.10 | 0.11 | 1.45 |

TABLE 6

Beta Phase Particles -Aspect Ratio Distributions (Combined Results)

| | AR10 | AR50 | AR90 | AR99 | AR99.9 | Min | Max |
|---|---|---|---|---|---|---|---|
| Aspect Ratio | 1.2 | 1.4 | 2.1 | 3.3 | 4.5 | 1.0 | 8.6 |

As shown in Table 5, the particle size distribution of the sample shows a very large amount of small particles. In Table 5, the D50 value is the median, where half of the population lies below this value in micrometers. Similarly, 10 percent of the population lies below the D10 value, 90 percent of the population lies below the D90 value, 99 percent of the population lies below the D99 value and 99.9 percent of the population lies below the D99.9 value. As shown in Table 5, while the maximum particle size was found to be 1.45 micrometers, the vast majority of the particles are much smaller than the maximum. As shown, 99% of the particles have a size of not greater than 0.80 micrometers as shown by the D90 value.

As shown in Table 6, the aspect ratio data indicates that a large volume of the particles are generally equiaxed. In Table 6, the AR50 value is the median, where half of the population lies below this aspect ratio value. Similarly, 10 percent of the population lies below the AR10 value, 90 percent of the population lies below the AR90 value, 99 percent of the population lies below the AR99 value and 99.9 percent of the population lies below the AR99.9 value. Again, while the maximum aspect ratio of any particle of the sample was 8.6, only 0.1% of the particles had an aspect ratio of 4.5 or higher and only 10% of the particles had an aspect ratio of 2.1 or higher. This means about 90% of the particles had an aspect ratio of less than 2.1.

Beta Phase Particle Measurement Procedure

Step 1—Preparation of the Sample

Longitudinal (L-ST) samples of the alloy to be tested are prepared for metallographical imaging by first grinding the sample for an appropriate period of time (e.g. for about 30 seconds) using progressively finer grit SiC paper starting at 120 grit, then 320 grit, then 600 grit, and then 1200 grit SiC paper. After grinding, the samples are polished for an appropriate period of time (e.g. about 2-3 minutes) using a sequence of silk cloth and mol cloth using a 3 micron diamond suspension followed by a sequence of silk cloth and mol cloth using a 1 micron diamond suspension. During these polishing steps, an appropriate lubricant may be used. The final polishing step uses 0.05 micron colloidal silica on a chem cloth. The sample is cleaned with dish soap and a cotton ball under running water.

Step 2—SEM Image Collection

After the samples are prepared, 30 elemental energy-dispersive X-ray maps are captured at the surface of the longitudinal (L-ST) section using a Thermofisher Apreo S scanning electron microscope (SEM) or comparable SEM. To collect the 30 X-ray maps, ten (10) areas are collected directly adjacent to the surface, ten (10) areas are collected along the quarter thickness (T/4) of the section, and ten (10) areas are collected along the half thickness (T/2) of the section. The image size is 1024×800 pixels at a magnification of 3500×. The pixel dimensions are x=0.03425 μm, y=0.03425 μm. The acceleration voltage is 10 kV at a working distance of 10.1 mm and a beam current of 3.2 nA. Using EDAX Apex Advanced version 2.0.0013.0001 software (or similar) the elemental map is captured with a 150 microsecond (μs) dwell time, an amp time of 0.24 microseconds (μs), with 16 frames being captured. The resulting magnesium elemental maps are saved in RGB color or TIF format for use in Step 3, below.

Step 3—Image Analysis and Determination of the Amount of and Size of Beta Phase Particles Next, the output magnesium elemental maps from Step 2 are processed to measure the size and amount of beta phase particles in the 5xxx aluminum alloy. The elemental maps may be processed as described below using an appropriate image manipulation program, such as the open source program called "ImageJ" (http://imagej.net/Open_source) or a similar software program.

First, if needed, the magnesium maps are cropped to exclude any extraneous data (e.g. the data bar) to leave an image of 1024×800 pixels. Next, if needed, the images are adjusted from RGB-color to 8-bit. The 8-bit images are then twice subjected to a "SMOOTH" function. Next, using the THRESHOLD tool, a dark background is applied to the image using a threshold of 59 where any pixel containing a greyscale value of 59 or above will be converted to white (255 greyscale) and all other pixels will be converted to black (0 greyscale). Next, the DESPECKLE tool is used (once) to clear outlier pixels. The resulting processed binary images are saved as TIF files for analysis. White pixels (255 greyscale) denote beta phase and clusters of greater than 8 connected white pixels are counted within each image and considered particles. A pixel size of x=0.03425 μm, y=0.03425 μm (micrometers) is used to quantify the size of particles and total area measured.

Next, the images are analyzed to determine particle characteristics. Image analysis may be completed by, for instance, IMAGEPRO software, which software is available from Media Cybernetics, Inc., 1700 Rockville Pike, Suite 240, Rockville, MD 20852 USA. The average beta phase particle size is calculated as the mean size of all particles counted. The area percent is calculated by dividing the total area of beta phase within each image by the total area measured. Aspect ratio is calculated by dividing the length of the major axis of the particle by the length of the minor axis of the particle, the major axis being the longest length of the particle and the minor axis being the shortest length of the particle. Statistics are calculated for individual sampling locations of surface (S), quarter thickness (T/4), and half-thickness (T/2)) and across the entire sample by combining the surface (S), quarter-thickness (T/4) and half-thickness (T/2) data and then completing the calculations.

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

What is claimed is:

1. A 5xxx aluminum alloy sheet product comprising:
- from 3.5 to 4.6 wt. % Mg;
- from 0.5 to 1.3 wt. % Mn;
- from 0.08 to 0.15 wt. % Sc;
- from 0.05 to 0.15 wt. % Zr;
- up to 0.8 wt. % Zn;
- up to 0.20 wt. % Cr;
- up to 0.20 wt. % V;
- up to 0.20 wt. % Cu;
- up to 0.15 wt. % Ti;
- up to 0.10 wt. % Fe;
- up to 0.10 wt. % Si;
- the balance being aluminum, incidental elements and impurities;
- wherein the 5xxx aluminum alloy sheet product has a thickness of from 0.5 to 8.0 mm;
- wherein the 5xxx aluminum alloy sheet product comprises at least 0.5 vol. % of beta phase particles;
  - wherein the beta phase particles include $(AlZm)_3Mg_2$ particles;
- wherein the beta phase particles define an aspect ratio distribution;
- wherein an AR99 of the aspect ratio distribution is not greater than 10.0;
- wherein the beta phase particles define a beta phase particle size distribution;
- wherein a D99 of the beta phase particle size distribution is not greater than 3.0 micrometers;
- wherein (wt. % Sc)+(wt. % Zr)≤0.20 wt. %.

2. The 5xxx aluminum alloy sheet product of claim 1, wherein the 5xxx aluminum alloy sheet product includes at least 0.15 wt. % Zn.

3. The 5xxx aluminum alloy sheet product of claim 2, wherein the 5xxx aluminum alloy sheet product includes not greater than 0.75 wt. % Zn.

4. The 5xxx aluminum alloy sheet product of claim 1, wherein the 5xxx aluminum alloy sheet product includes not greater than 0.14 wt. % Sc.

5. The 5xxx aluminum alloy sheet product of claim 4, wherein the 5xxx aluminum alloy sheet product includes not greater than 0.14 wt. % Zr.

6. The 5xxx aluminum alloy sheet product of claim 1, wherein the 5xxx aluminum alloy sheet product includes not greater than 0.15 wt. % Cu.

7. The 5xxx aluminum alloy sheet product of claim 1, wherein the 5xxx aluminum alloy sheet product comprises at least 0.75 vol. % of the beta phase particles.

8. The 5xxx aluminum alloy sheet product of claim 7, wherein the AR99 of the aspect ratio distribution is not greater than 9.0.

9. The 5xxx aluminum alloy sheet product of claim 8, wherein the D99 of the beta phase particle size distribution is not greater than 2.8 micrometers.

10. The 5xxx aluminum sheet product of claim 1, wherein the 5xxx aluminum alloy sheet product is unrecrystallized.

11. The 5xxx aluminum sheet product of claim 10, wherein the 5xxx aluminum sheet is strength retentive, wherein the 5xxx aluminum sheet product realizes a tensile yield strength (TYS) of not greater than 50 MPa from a final annealed condition to a creep annealed condition.

12. The 5xxx aluminum alloy sheet product of claim 1, wherein the aluminum alloy sheet product realizes a tensile yield strength in the longitudinal (L) direction or the long transverse (LT) direction of at least 300 MPa.

13. The 5xxx aluminum alloy sheet product of claim 1, wherein the aluminum alloy sheet product realizes an elongation in the longitudinal (L) direction or the long transverse (LT) direction of at least 5%.

14. A method of making a 5xxx aluminum alloy sheet product, the method comprising:

casting an aluminum alloy ingot, wherein the aluminum alloy ingot comprises:

from 3.5 to 4.6 wt. % Mg;

from 0.5 to 1.3 wt. % Mn;

from 0.08 to 0.15 wt. % Sc;

from 0.05 to 0.15 wt. % Zr;

wherein (wt. % Sc)+(wt. % Zr)≤0.20 wt. %;

up to 0.8 wt. % Zn;

up to 0.20 wt. % Cr;

up to 0.20 wt. % V;

up to 0.20 wt. % Cu;

up to 0.15 wt. % Ti;

up to 0.10 wt. % Fe;

up to 0.10 wt. % Si;

the balance being aluminum, incidental elements and impurities;

homogenizing the ingot;

hot rolling the ingot to an intermediate gauge material;

cold rolling the intermediate gauge material to a final gauge sheet product, wherein the final gauge sheet product has a thickness of from 0.5 to 8.0 mm; and annealing the final gauge sheet product at a final anneal temperature, wherein the final anneal temperature is not greater than T-anneal (max), and wherein the final anneal temperature is from 145-278° C. (293-532° F.);

wherein the final gauge sheet product comprises at least 0.5 vol. % of beta phase particles:

wherein the beta phase particles include $(Al,Zn)_3Mg_2$ particles.

15. The method of claim 14, wherein the final anneal temperature is not greater than 270° C. (518° F.).

16. The method of claim 15, wherein the final anneal temperature is at least 150° C. (302° F.).

17. The method of claim 14, wherein the annealing is for a final anneal hold time, wherein the final anneal hold time is from 5 minutes to 100 hours.

18. The method of claim 14, wherein the T-anneal (max), in degrees Fahrenheit, is not greater than the output of:

$$116.3+(97.7*(\text{wt. \% Mg}))-(87*(\text{wt. \% Si}))+(11.6*(\text{wt. \% Mn}))+(105.8*(\text{wt. \% Zn}))-(5.04*(\text{wt. \% Mg})^2)-(41.7*(\text{wt. \% Zn})^2).$$

19. The method of claim 14, wherein the final anneal temperature is not greater than 245° C. (473° F.).

* * * * *